US011005204B2

(12) United States Patent
Soubh

(10) Patent No.: US 11,005,204 B2
(45) Date of Patent: May 11, 2021

(54) HIGH SPEED ELECTRICAL CONNECTOR ASSEMBLY

(71) Applicant: Carlisle Interconnect Technologies, Inc., St. Augustine, FL (US)

(72) Inventor: Emad Soubh, Camas, WA (US)

(73) Assignee: Carlisle Interconnect Technologies, Inc., St. Augustine, FL (US)

( * ) Notice: Subject to any disclaimer, the term of this patent is extended or adjusted under 35 U.S.C. 154(b) by 0 days.

(21) Appl. No.: 16/037,291

(22) Filed: Jul. 17, 2018

(65) Prior Publication Data

US 2020/0028295 A1 Jan. 23, 2020

(51) Int. Cl.

| | |
|---|---|
| ***H01R 13/11*** | (2006.01) |
| ***H01R 13/187*** | (2006.01) |
| ***H01R 13/424*** | (2006.01) |
| ***H01R 13/04*** | (2006.01) |
| ***H01R 13/422*** | (2006.01) |
| *H01R 4/02* | (2006.01) |

(52) U.S. Cl.

CPC ..... *H01R 13/111* (2013.01); *H01R 13/04* (2013.01); *H01R 13/187* (2013.01); *H01R 13/424* (2013.01); *H01R 13/4223* (2013.01); *H01R 4/02* (2013.01)

(58) Field of Classification Search

CPC .... H01R 13/111; H01R 13/04; H01R 13/187; H01R 13/4223; H01R 13/424; H01R 4/02; H01R 13/6315; H01R 13/10; H01R 13/052; H01R 13/6477; H01R 12/73

USPC ..... 439/851, 246, 252, 842, 843, 856

See application file for complete search history.

(56) References Cited

U.S. PATENT DOCUMENTS

| | | | | | |
|---|---|---|---|---|---|
| 3,120,418 | A | | 2/1964 | Deakin | |
| 4,721,484 | A | | 1/1988 | Sakamoto et al. | |
| 4,722,704 | A | | 2/1988 | VanDerStuyf et al. | |
| 4,874,338 | A | | 10/1989 | Bakermans | |
| 5,326,288 | A | * | 7/1994 | Lu | H01R 13/111 439/851 |
| 5,334,035 | A | * | 8/1994 | Wehrle | H01R 13/422 439/246 |
| 5,651,705 | A | * | 7/1997 | Hsu | H01R 13/111 439/852 |
| 5,820,423 | A | * | 10/1998 | Hsu | H01R 13/111 439/851 |
| 5,997,363 | A | * | 12/1999 | Joly | H01R 13/521 439/748 |

(Continued)

*Primary Examiner* — Travis S Chambers

(74) *Attorney, Agent, or Firm* — Wood Herron & Evans LLP

(57) ABSTRACT

A high speed electrical connector assembly includes a mating female connector with sockets and male connector with pins. The female connector includes a connector body formed to define a mount face surface and contact face surface and one or more apertures extending therebetween. One or more sockets are positioned in the connector body apertures. The socket includes a mount portion and a pin receiving portion and the mount portion is configured for engaging an internal surface of the aperture proximate the mount face surface for securing the socket in the aperture. The pin receiving portion is maintained in a free-floating position away from the internal surface of the aperture with a tip end of the pin receiving portion being positioned below the contact face surface. An air gap is formed in the aperture around the free-floating portion and tip end.

16 Claims, 17 Drawing Sheets

(56) References Cited

U.S. PATENT DOCUMENTS

| | | | | |
|---|---|---|---|---|
| 6,261,134 | B1 * | 7/2001 | Muzslay | H01R 43/16 29/857 |
| 6,869,321 | B1 * | 3/2005 | Ashby | H01R 13/14 439/246 |
| 7,080,999 | B2 * | 7/2006 | Narui | H01R 13/6315 439/246 |
| 7,201,617 | B2 | 4/2007 | Okamoto et al. | |
| 7,658,654 | B2 | 2/2010 | Ohyama et al. | |
| 7,722,394 | B2 | 5/2010 | Feldman et al. | |
| 8,079,885 | B1 | 12/2011 | Lin | |
| 9,362,645 | B2 | 6/2016 | Meunier | |
| 2012/0329338 | A1 * | 12/2012 | Umemura | H01R 13/2421 439/733.1 |
| 2018/0212340 | A1 * | 7/2018 | Bhagyanathan-Sathlanathan | H01R 4/185 |

* cited by examiner

HIGH SPEED ELECTRICAL CONNECTOR ASSEMBLY

FIELD OF THE INVENTION

This invention relates generally to the field of connectors, and specifically to high-speed connectors.

BACKGROUND OF THE INVENTION

In the field of electrical connectors, and particularly in high-speed connectors, there is a desire for faster data rates to be achieved. Furthermore, for connectors that are utilized to connect between printed circuit boards, there is a desire to minimize the connector size in order to preserve necessary real estate on the printed circuit board. Furthermore, such connectors must be robust and provide suitable signal quality within a rugged construction.

Current connector solutions often do not offer a package that provides all of the desired features. For example, often such connectors are dedicated to a particular type of mounting technology between the circuit boards, such as paste-in-hole technology or plated-through-hole technology or surface mounted technology. As such they can only be used in a single application or mounting scenario. Furthermore, such dedicated designs do not provide any flexibility in signal routing and coding schemes, such as to be able to accommodate single-ended, differential pair, power, ground, and sideband signals. Furthermore, existing applications do not address different impedance options that may be necessary to meet a particular application. Still further, existing connector assemblies do not provide desirable signal conductor arrangements in the connector that ensures high signal integrity and reliability of a significant number of mating in de-mating cycles.

Accordingly, there is a need in the industry for a high-speed connector design that is flexible, and scalable, and can address some of the drawbacks of existing connectors.

SUMMARY OF THE INVENTION

A high speed electrical connector assembly includes a mating female connector with sockets and male connector with pins. The female connector includes a connector body formed to define a mount face surface and contact face surface and one or more apertures extending therebetween. One or more sockets are positioned in the connector body apertures. The socket includes a mount portion and a pin receiving portion and the mount portion is configured for engaging an internal surface of the aperture proximate the mount face surface for securing the socket in the aperture. The pin receiving portion is maintained in a free-floating position away from the internal surface of the aperture with a tip end of the pin receiving portion being positioned below the contact face surface. An air gap is formed in the aperture around the free-floating portion and tip end.

BRIEF DESCRIPTION OF THE DRAWINGS

It should be understood that the appended drawings are not necessarily to scale, presenting a somewhat simplified representation of various features illustrative of the basic principles of the invention. The specific design features of the sequence of operations as disclosed herein, including, for example, specific dimensions, orientations, locations, and shapes of various illustrated components, will be determined in part by the particular intended application and use environment. Certain features of the illustrated embodiments have been enlarged or distorted relative to others to facilitate visualization and clear understanding. In particular, thin features may be thickened, for example, for clarity or illustration.

DETAILED DESCRIPTION OF THE INVENTION

Figure 1:
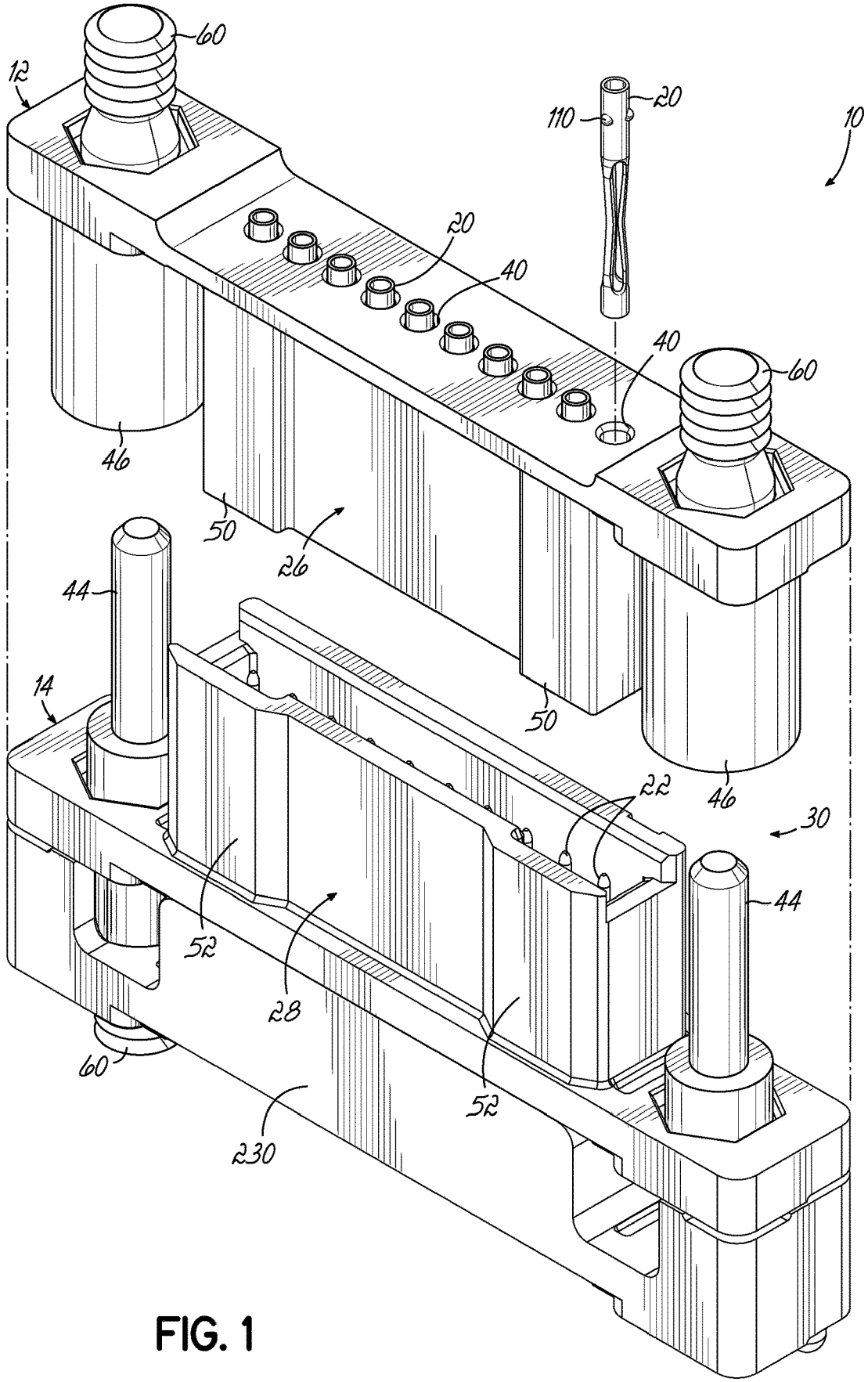
FIG. 1 is a perspective view showing a high speed electrical connector assembly in accordance with one embodiment of the invention.

FIG. 1 illustrates a perspective view of an embodiment of the high-speed electrical connector assembly 10 of the invention. The electrical connector assembly 10 includes a female connector 12 that couples or connects with the male connector 14. Generally, the female and male connectors are designated as such, in conventional connector terms, because they include at least one socket element or socket 20 (female) for receiving at least one pin element or pin 22 (male) when the male and female connectors are mated together for inserting the pin 22 into the socket 20. However, the features of the invention are not limited to the male/female designations.

The embodiments of the invention illustrated herein include female and male connectors which includes a plurality of sockets and pins for forming an array of electrical connections within a compact design. Referring to FIG. 1, the female connector includes a connector body as configured for housing the one or more sockets 20 as illustrated. Similarly, the male connector 14 includes a connector body 28 that is configured for housing the one or more pins 22. As discussed further below, each of the connector bodies might be made up of several stackable body portions. Therefore, the term "connector body" may be utilized to indicate a single body or multiple body portions are coupled together to essentially form the connector body.

Figure 2:
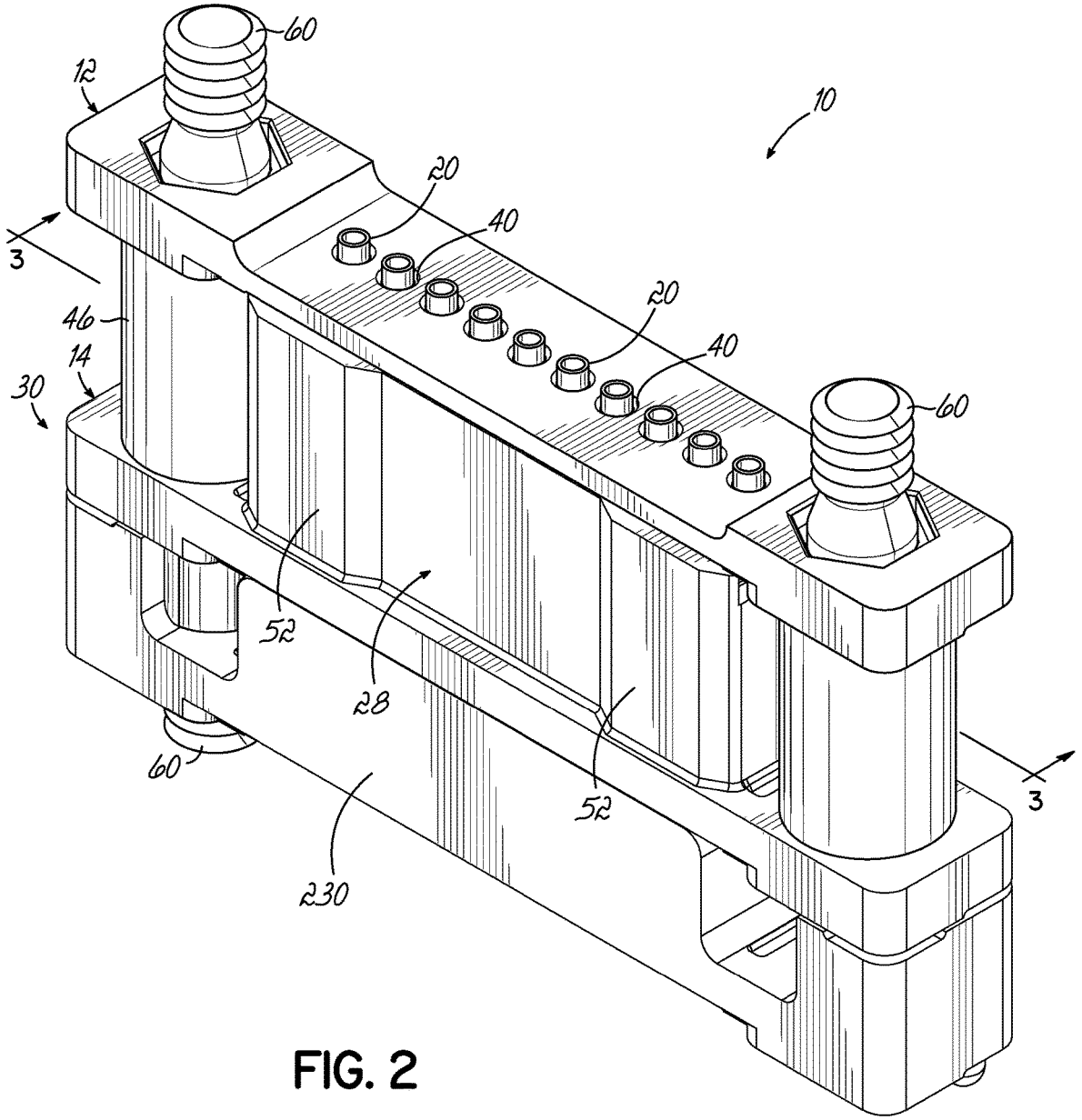
FIG. 2 is a perspective view showing mated male and female connectors in accordance with one embodiment of the invention.
Figure 3:
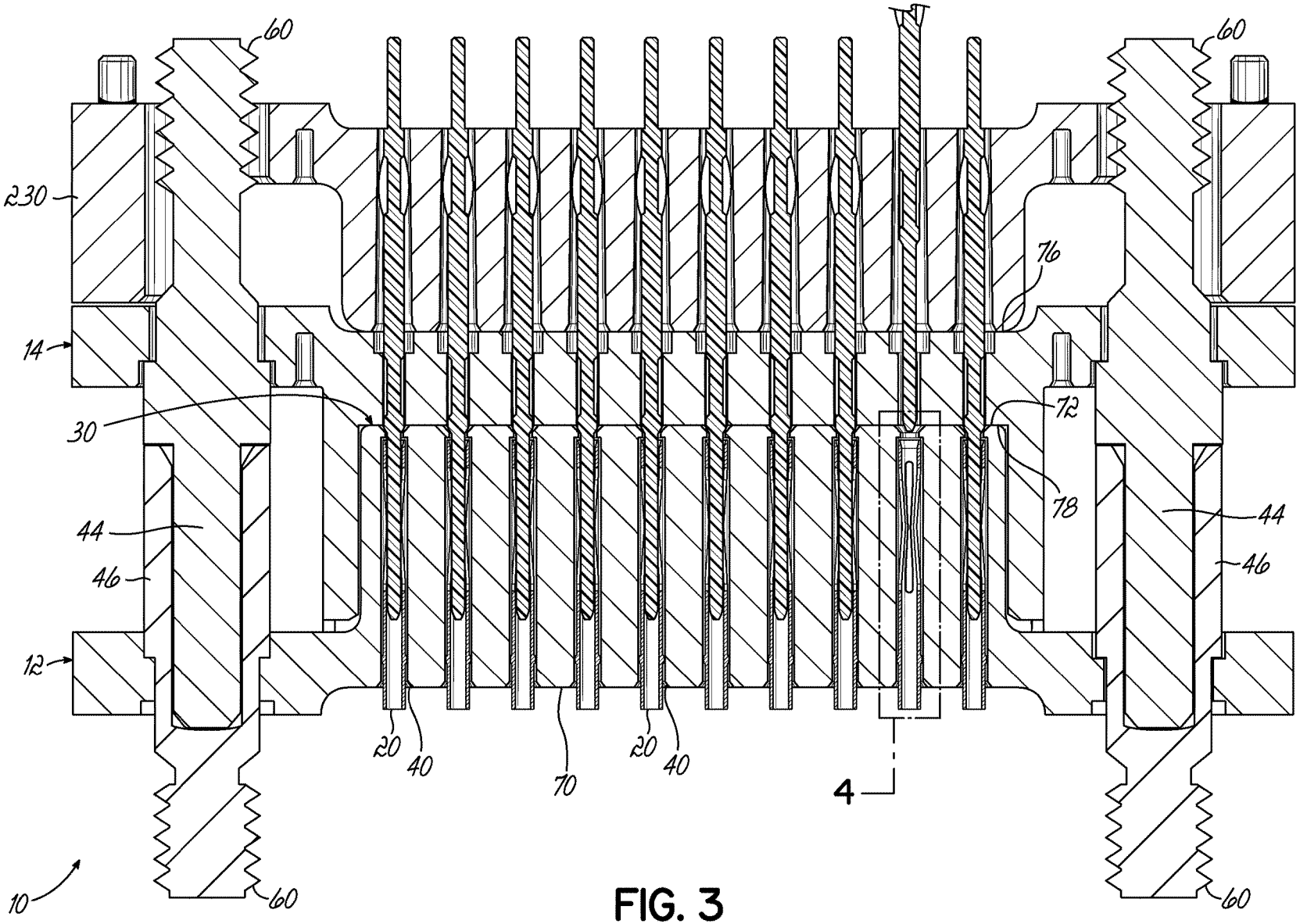
FIG. 3 is a cross-sectional view of a mated connector assembly in accordance with one embodiment of the invention.

Each of the connector bodies 26, 28 are configured for mating together to facilitate the insertion of the one or more pins 22 into the one or more sockets 20. For example, FIG. 2 illustrates a mated high-speed electrical connector assembly in accordance with the invention wherein the male and female connectors are mated for providing an electrical connection across a connector interface 30. Referring to FIGS. 1 and 3, generally the connector body 26 of the female connector will be a somewhat solid body that has a plurality of apertures 40 that extend therein. The apertures 40 are configured for receiving the various sockets 20 to provide the inventive connector as described herein with specific improved electrical performance.

Figure 5:
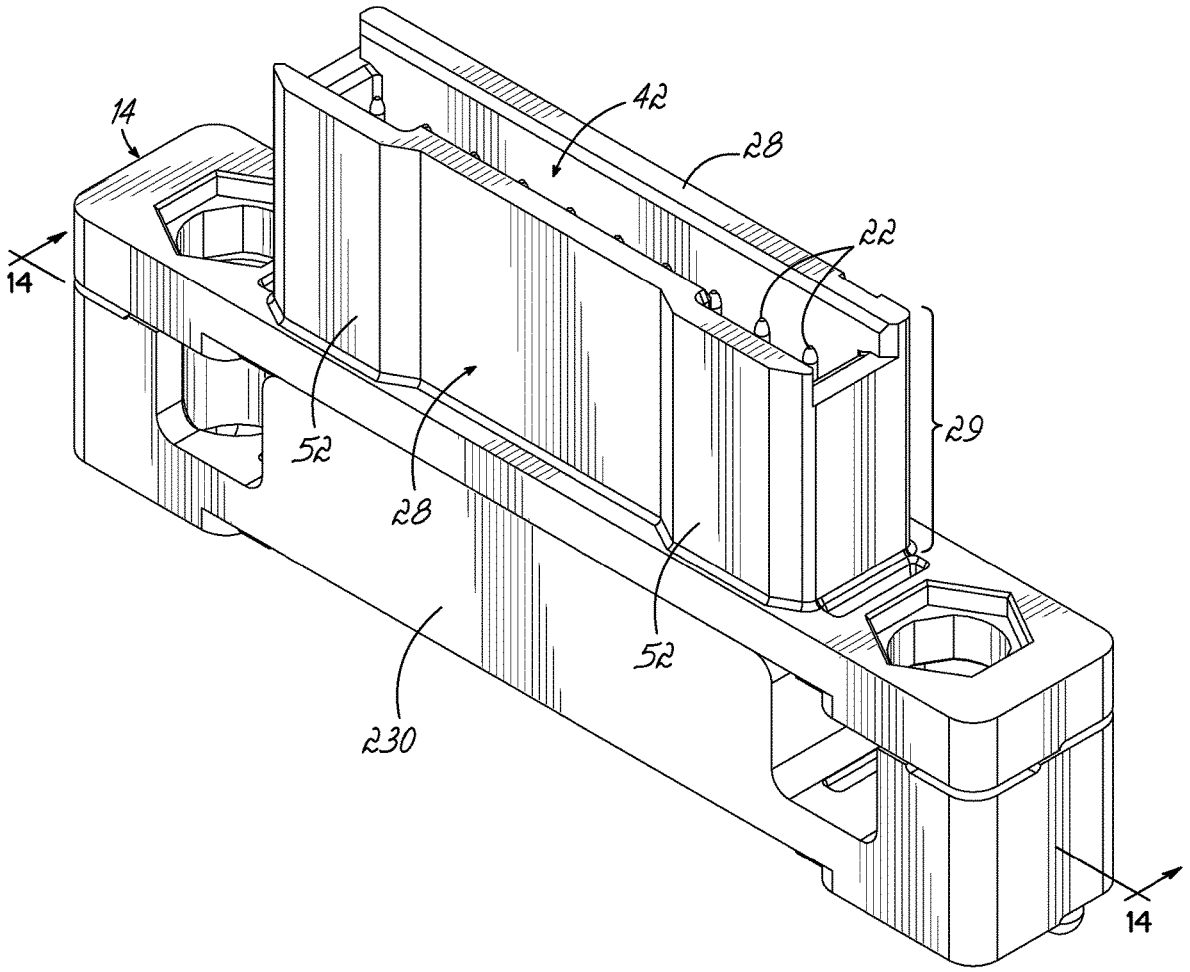
FIG. 5 is a perspective view of an embodiment of a male connector in accordance with one embodiment of the invention.

The male connector, on other hand, as illustrated in FIGS. 1 and 5 includes a connector body 28 that is open or forms a space 42 therein for allowing the pins 22 to extend freely in the space so that they can then engage and be inserted into a corresponding socket. As such, in the embodiment illustrated in the figures, the connector body of the female connector is configured to essentially fit into the space 42 of the male connector body 28 so that the two connectors form a connector assembly that is flush at the interface 30 as shown in FIG. 2 when the male and female connectors are mated together.

Referring again to FIG. 1, each of the connectors might include alignment mechanisms for providing proper alignment of the pins and sockets so as to prevent damage to the pins and sockets when the male and female connectors are mated together. Referring to FIG. 1, in one illustrated embodiment, the connectors include alignment pins 44 and respective alignment apertures 46 that receives such pins in order to provide proper alignment of male-female connectors. Furthermore, each of the connector bodies 26, 28 might include features that provide for alignment. As illustrated in FIG. 1, the female connector body 26 includes bumped out portions 50 at each end of the connector body that then engage respective indent portions 52 formed in the male connector body 28.

The embodiments illustrated in the figures are generally formed for connecting with circuit boards, for providing load-to-board connector. However, the inventive high-speed electrical connector assembly as disclosed herein might also be utilized to terminate a cable, with appropriate modifications to the connector bodies for securing the cable with the bodies as would be understood by a person of ordinary skill in the art.

For board connections, each of the connectors 12, 14 might include elements for coupling the connectors to a printed circuit board (PCB). For example, as shown in FIGS. 1-3, each of the connectors includes one or more threaded posts 60 that can be threaded into an appropriate structure on a printed circuit board for physically securing the male or female connector to a respective board with the sockets or pins electronically coupled with conductive elements or trace or the PCB. Of course, other structures might be utilized, and the present invention is not limited to the types of mounting arrangements used for securing the high-speed electrical connector assembly elements to respective printed circuit boards.

Figure 6:
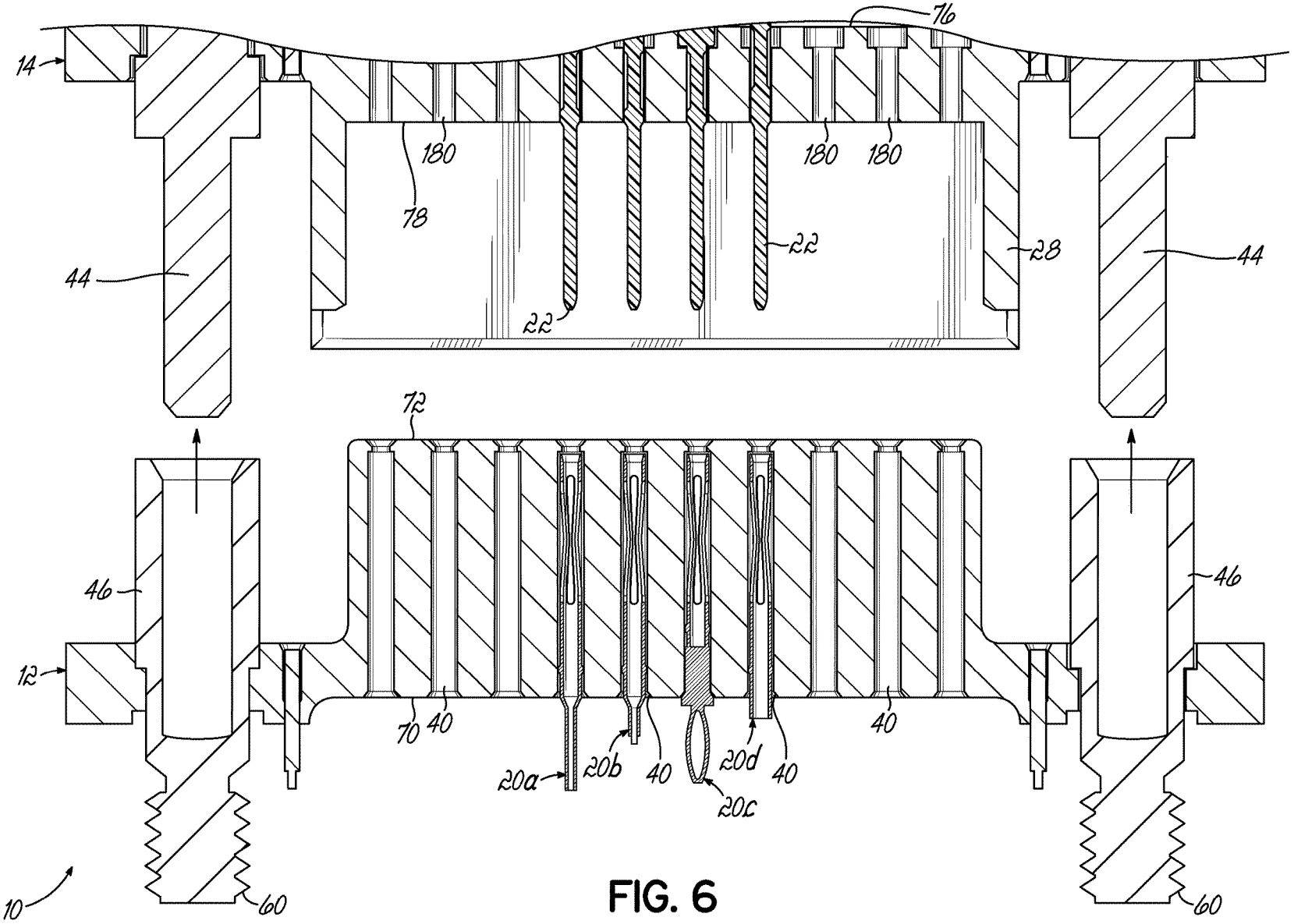
FIG. 6 is a cross-sectional view of male and female connectors in accordance with one embodiment of the invention.

Referring now to FIG. 6, male and female connectors are shown in cross-section wherein the various apertures 40 each hold a respective socket 20. One end of each of the connector bodies 26, 28 is coupled with a PCB and thus forms a mount face surface 70 on one end. The other end of the connector body that couples with the opposing connector body at the interface 30 forms a contact face surface 72. Similarly, referring to FIGS. 6 and 14, the connector body 28 of the male connector has a mount face surface 76 and a contact face surface 78. Referring to FIG. 3, the contact face surfaces 72, 78 meet at the interface 30 when the male and female connectors are mated. This assures that the various pins of the male connector are appropriately seated and inserted into the various sockets of the female connector as shown in FIG. 3.

Figure 7:
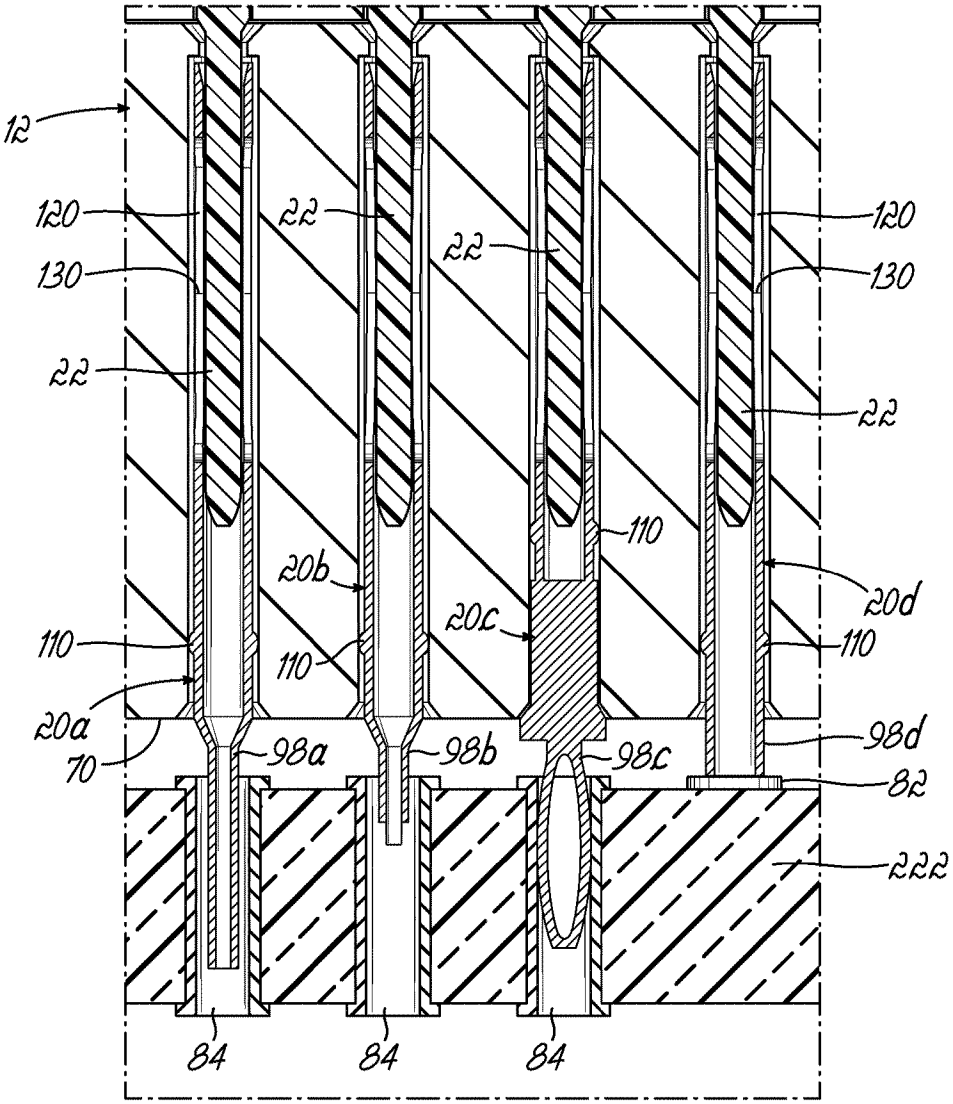
FIG. 7 is a partial cross-sectional view of socket conductors with different terminations in accordance with embodiments of the invention.

In accordance with one feature of the invention, the connector assembly 10 is modular wherein various different sockets and/or pins might be implemented within a connector body depending upon the mounting scenario for the connector body to a printed circuit board. For example, each of the sockets and pins may be appropriately configured for different termination styles within a PCB at the respective mount face surfaces 70, 76. For example, the pins or sockets of the various connectors might be interfaced with the printed circuit boards through one or more of the following: Surface Mount Technology (SMT), press fit or compliant fit, Paste-In-Hole (PIH) technology, plated-through-hole (PTH) technology or other suitable technology that might be utilized for interfacing the termination end of one of the pin or socket conductor elements to the printed circuit board. Referring specifically to FIG. 7, a PCB 222 is shown to include electrically conductive elements thereon, such as one or more pads 82, that might be used for surface mounting or one or more plated through holes 84, that may be utilized for other mounting technology. Each of the pins and sockets will have a termination portion that provides a suitable interface with the respective element 82, 84 of a printed circuit board 80 as illustrated in FIG. 7. Generally, the termination portions are coupled below the mount portions of the pins or sockets, which engage the respective apertures in the connector body.

Referring to FIGS. 8A-8D, a plurality of exemplary embodiments of modular sockets in accordance with the invention are illustrated. Each of the sockets **20*a*-20*d* includes a termination portion for coupling with a printed circuit board or other structure, such as a cable structure, for providing signals to the sockets. The sockets further include a mount portion for mounting the sockets within the connector bodies and a pin receiving portion coupled with the mount portion for receiving the pins from the male connector. More specifically, referring to FIGS. 8A-8D, the mount portions 90, 92 of each of the sockets are configured for engaging an internal surface 94 of an aperture 40 proximate to a mount face surface 70 of the connector for securing the socket 20 in the aperture 40 (see FIG. 4). In one embodiment, the engagement is a friction-fit engagement. Each of the sockets further includes the termination portion indicated in FIGS. 8A-8D as termination portions 98***a*, 98*b*, 98*c*, 98*d* depending upon the type of termination and the connection to a printed circuit board or other signal carrying medium. Finally, each of the sockets further includes a pin receiving portion 100 for receiving a pin of the male connector as discussed herein.

Figure 8A:
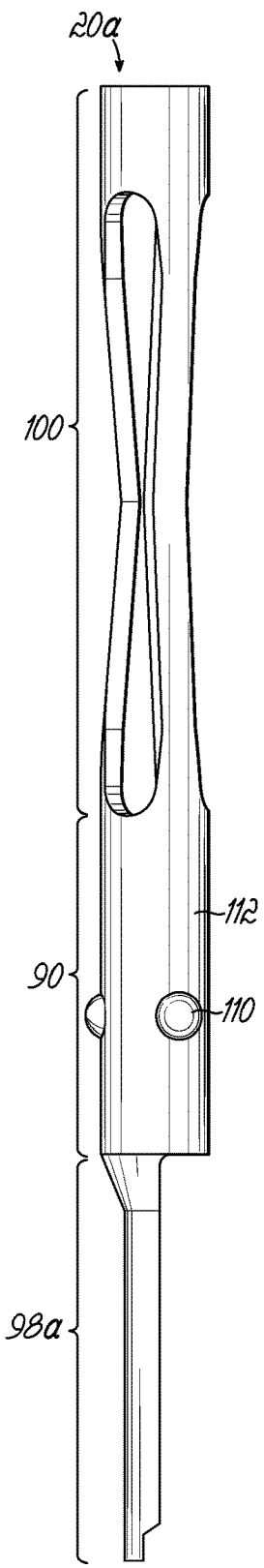
FIGS. 8A-8D are side views of various socket conductors with different terminations in accordance with embodiments of the invention.
Figure 8B:
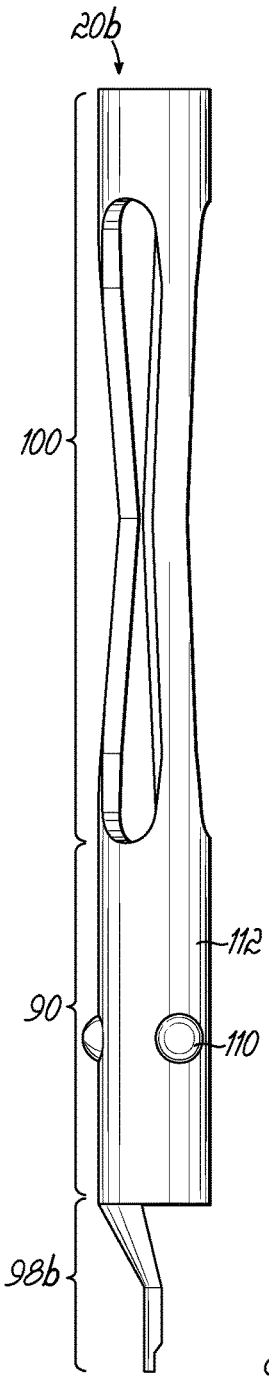
Figure 8C:
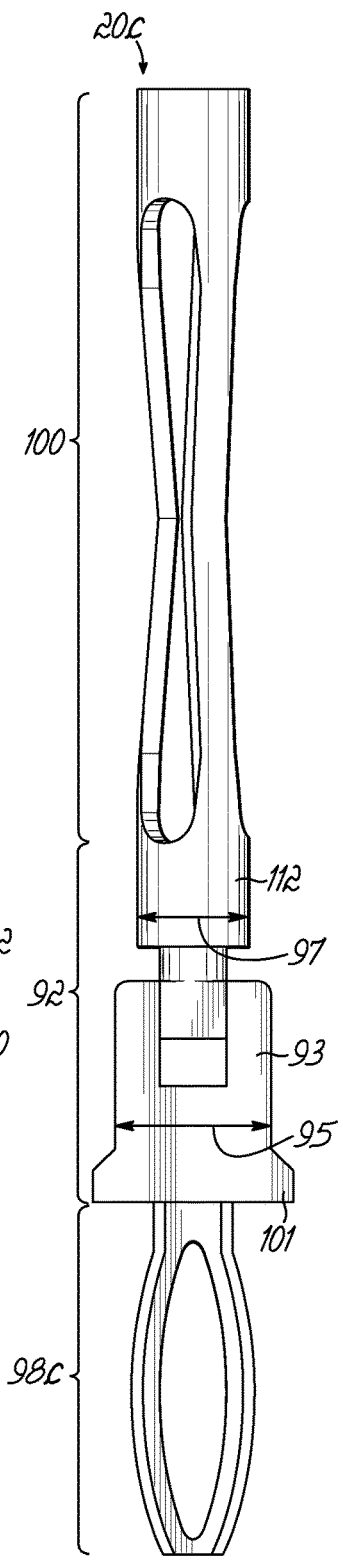
Figure 8D:
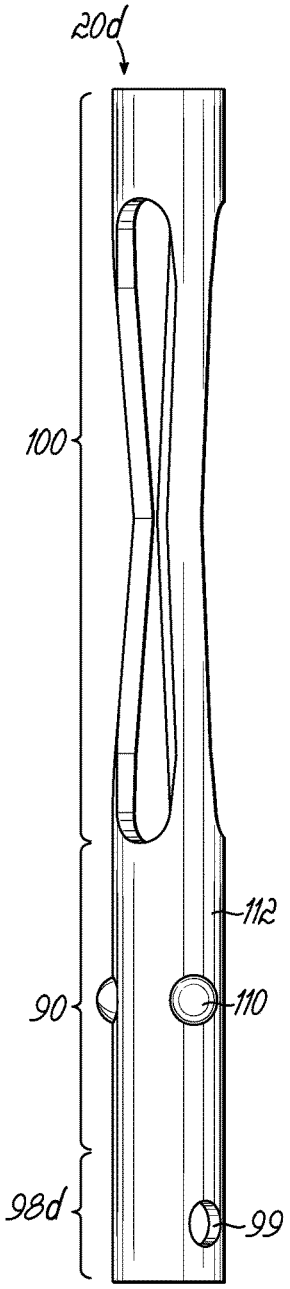

Referring to FIGS. 7 and 8A-8D, socket 20*a* is illustrated with a termination portion 98*a* it might be suitable for plated-through-hole technology, such as using wave soldering. Socket 20*b* of FIG. 8B has a termination portion 98*b* that might be suitable for paste-in-hole technology. Socket 20*c* as illustrated in FIG. 8C has a termination portion that is considered a compliant termination portion that may be press fit into a plated through hole 84 as illustrated in FIG. 7. FIG. 8D on the other hand illustrates a socket 20*d* that has a termination portion 98*d* suitable for a surface mount technology, as shown in FIG. 7. Accordingly, depending upon the application, the present invention provides modularity within a conductor making the high-speed electrical connector assembly of the invention versatile and usable in a number of different applications. The termination portion 98*d* of FIG. 8D might include one or more apertures 99 such as for passage of solder in the surface mount application. Generally, a connector will use one type of mounting technology for a connector. Therefore, all the sockets in a connector might have the same termination portion. However, the modularity of the invention provides the ability to mix multiple different termination portions into a single connector body.

Figure 4:
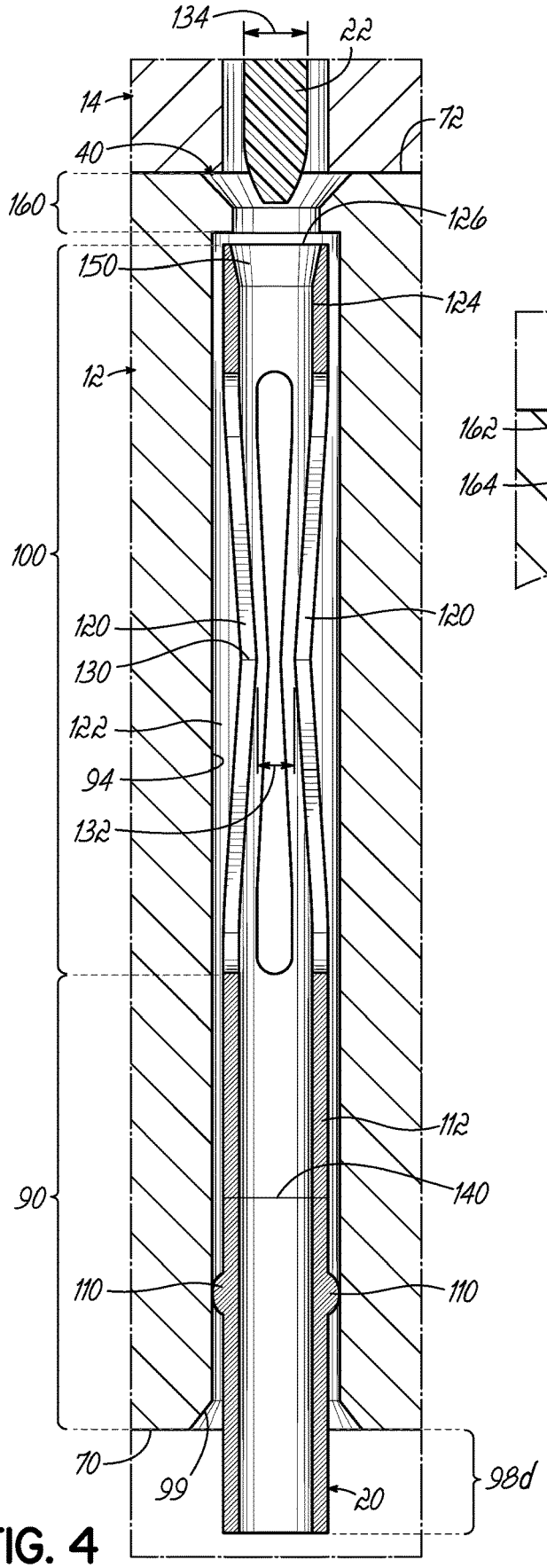
FIG. 4 is a partial cross-sectional view of a socket conductor in accordance with one embodiment of the invention.

For securing each of the sockets in a respective aperture 40, a mount portion of the socket includes features appropriate and configured for engaging the internal surface 94 of the aperture for securing the socket in the aperture. In several of the embodiments as illustrated in the Figures, the mount portions 90, 92 include one or more protrusions 110 that extend radially outwardly from an outer surface 112 of the sockets. As such, the protrusions 110 increase an effective outer diameter of the outer surface 112 and extend radially outwardly to a diameter greater than an inner diameter of the aperture inner surface 94. As such, the protrusions 110 engage inner surface 94 in a friction fit proximate to the mount surface 70 of the connector body as illustrated in FIG. 4. One or more of the protrusions 110, such as three or four protrusions, extend around the circumference of the outer surface 112 for centering and properly securing the socket 20 within the aperture 40. While protrusions 110 in the form of circular bumps are shown in some of the illustrated embodiments of the invention, other embodiments might utilize other shape protrusions. For example, in the illustrated embodiments, protrusions in the form of fins are utilized for securing conductive elements, such as, pins within the male connector as described herein. As such, the specific shape of the protrusions is not limited specifically to those illustrated in the figures. The protrusions extend radially outwardly from the outer surface 112 to create a larger effective outer diameter for the mount portion 90 of the various sockets in order to properly secure the socket. The mount portion may be press fit into a respective aperture 40 from the end of the connector defining the mount face surface 70. In one embodiment of the invention, the connector body may be formed of a suitable plastic material such as a LCP. In one embodiment the invention, a 30% glass-filled LCP formed per standard ASTM D5138 might be utilized. As such, the socket would be press fit and placed therein.

Figure 10:
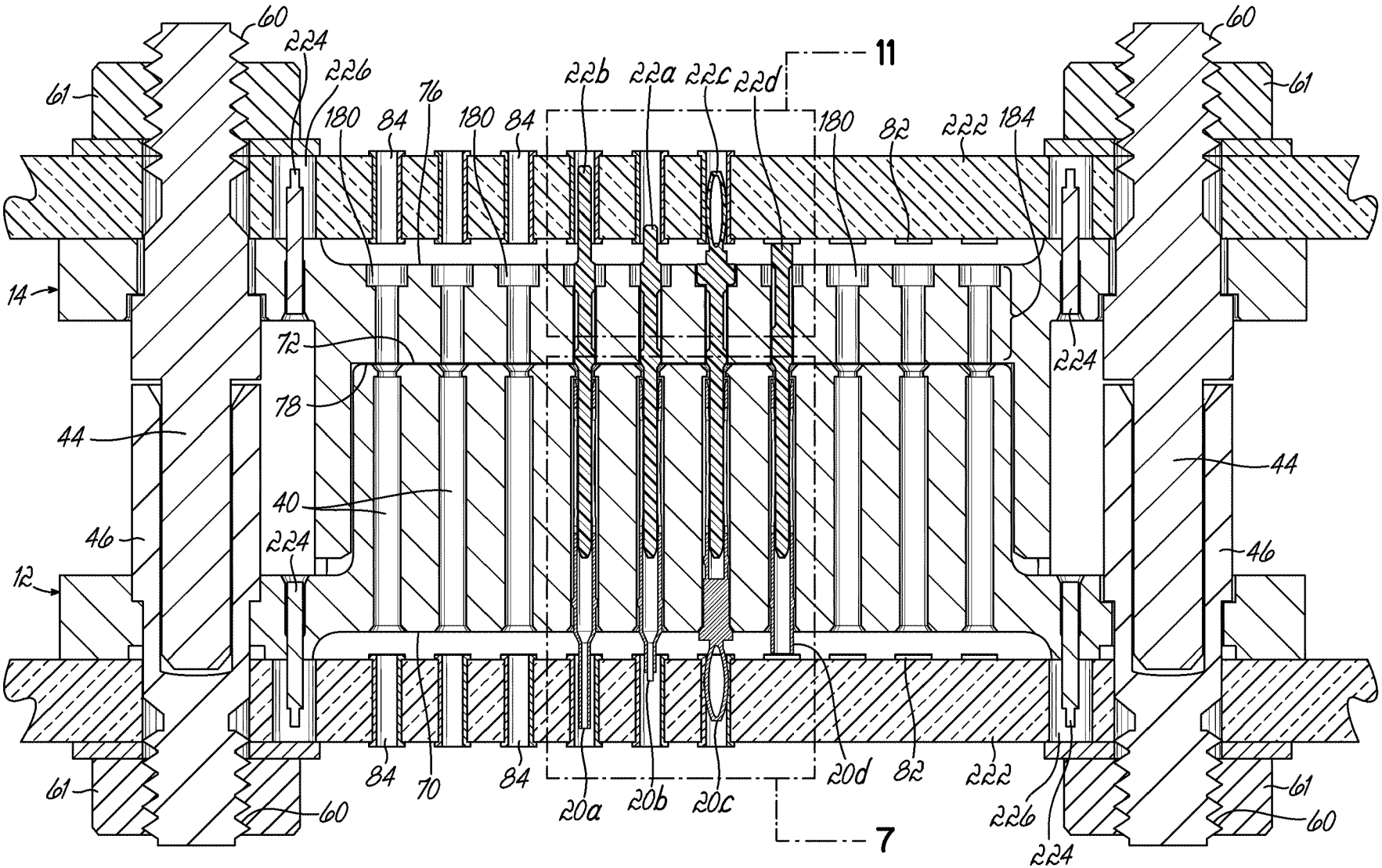
FIG. 10 is a cross-sectional view of a connector assembly in accordance with one embodiment of the invention incorporated between circuit boards.

Referring to FIG. 8C, an alternative embodiment of the socket 20*c* is shown with a mount portion that is specifically configured with a larger outer diameter for use with sockets having a termination portion 98*c* that may be used for press fit mounting to a circuit board. More specifically, referring to FIGS. 7 and 8C, the socket 20*c* includes a section 93 within the mount portion 92 that has a larger outer diameter 95 than the outer diameter 97 of the pin receiving portion 100 of the socket. In that way, when the mount portion 92 is press fit into an aperture 40, it engages the inside surface 94 of the aperture along a significant length to provide a more robust mounting of the socket. Furthermore, referring to FIG. 4, the aperture 40 includes a flared section 99 at one end of the aperture proximate to mount face surface 70. Socket 20*c* includes a corresponding shoulder or collar 101 at an end thereof as illustrated in FIG. 8C that will engage the flared section 99 and prevent further insertion of the socket 20*c* and mount portion 92 in the aperture 40. This provides a tighter fit and securement of the mount portion 92 within the aperture. The more robust friction fit of mount portion 92 in socket 20*c* will provide for a counter to the forces that are necessary for deforming the termination portion 98*c* that is necessary for proper a press fit engagement with a plated through hole, as illustrated in FIG. 7 and FIG. 10.

In accordance with one aspect of the invention, the pin receiving portion of socket 20 is maintained in a free-floating position within each of the apertures 40. Specifically, the socket is maintained in the free-floating position away from an internal surface 94 of the aperture. An air gap is formed in the aperture around the free-floating portion for improving the impedance aspects of the connector. As a result, larger pins may be utilized which can carry greater signal amplitudes (for example, greater than 2 Amps) at increased speeds. Furthermore, the connector assembly provides for a smaller pitch between the pins and thus greater density within a smaller package. In one embodiment of the invention, the pitch might be 0.050 inch spacing or pitch between the connector pin or socket elements. Furthermore, the electrical connector assembly is able to provide greater control of the impedance even with a high density of conductors and smaller connector body. For example, the present invention yields 50 or 75 ohm single-ended impedance and 85 or 100 ohm differential impedance.

Referring to FIG. 4, socket 40 and specifically the pin-receiving portion 100 of the socket is formed to include a plurality of spring fingers 120 that flex radially inwardly along the length of the socket. As illustrated in FIG. 4, once the mount portion 90, 92 of a socket has been properly seated within section of the aperture 40 proximate to the mount face surface 70, the pin receiving portion 100 of the socket extends forwardly and is held in the free-floating position as shown in FIG. 4 away from the internal surface 94 of the aperture. This creates air gap 122 all around the pin receiving portion 100. The amount of the air gap is further enhanced by the springs 120 that flex radially inwardly in the socket and away from surface 94 as shown in FIG. 4.

In accordance with another aspect the invention, the tip end 124 of the pin receiving portion is positioned below the contact face surface 72 of the connector body. As such, an air gap 126 is also formed in the aperture around the tip end 124. The spring fingers 123 are positioned generally at 120° increments around the socket 20. As such, the socket provides a solid contact at three positions around pin 22 for a robust electrical connection. Generally, the spring fingers

120 will flex inwardly to form an effective inner-diameter at flex points 130 for contacting pins 22. Inner-diameter 132 is smaller than the outer diameter 134 of the male pins 22. The outer pin diameter 134 of one embodiment of the connector is dimensioned to be approximately 0.009-0.012 inches. The aperture, on the other hand has an inner diameter 132 of approximately 0.008-0.009 inches. Accordingly, when the male and female connector are mated and the pins inserted into respective sockets, the air gap 122 remains for desirable impedance features provided by the invention.

In one embodiment of the invention, the sockets as shown in FIGS. 8A-8D are formed of beryllium copper. For an example, beryllium copper formed pursuant to an ASTM D194 standard may be suitable. The contact may then be plated with a suitable nickel plating. In one embodiment, the nickel plating might be 100 micro-inches or greater within the mated contact area or essentially the pin receiving portion 100. Furthermore, a plating of gold over the nickel may be utilized. For example, a gold plating layer of 30-50 micro-inches might be used for the mated contact area of pin receiving portion 100. Also, in one embodiment, the plating of gold is also provided over the termination portion. For example, 5 micro inches of gold might be provided over the nickel in the various termination portions 98*a*-98*d* as illustrated in FIGS. 8A-8D. The nickel plating might be applied per ASTM B689 type 1 standard. The gold might be applied per ASTM B488 standard.

Figure 9A:
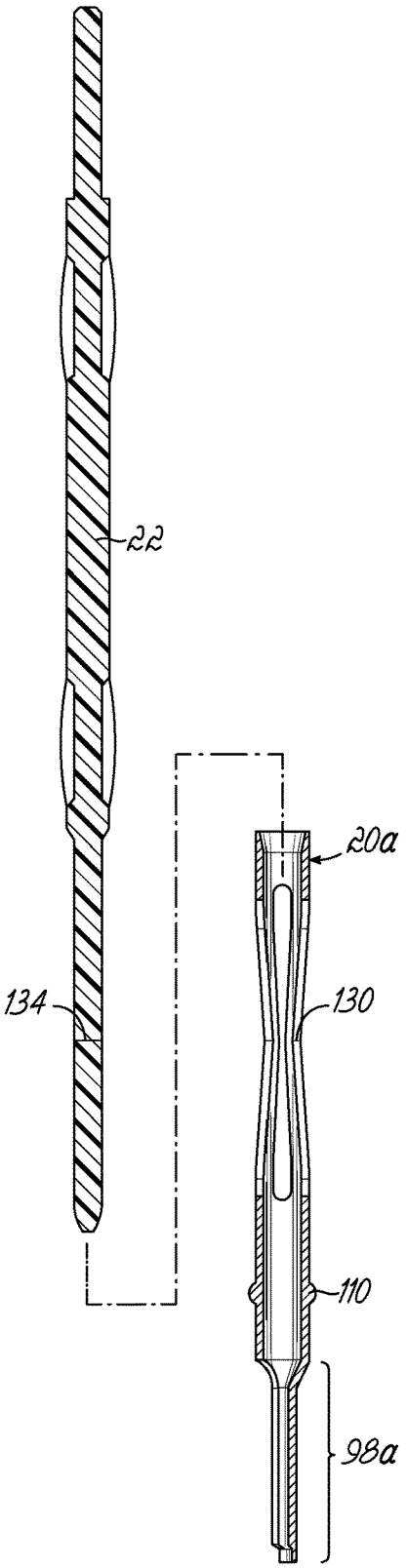
FIGS. 9A-9B are cross-sectional views showing pin conductors and socket conductors mated edge with the machining device to provide a first tapered edge.
Figure 9B:
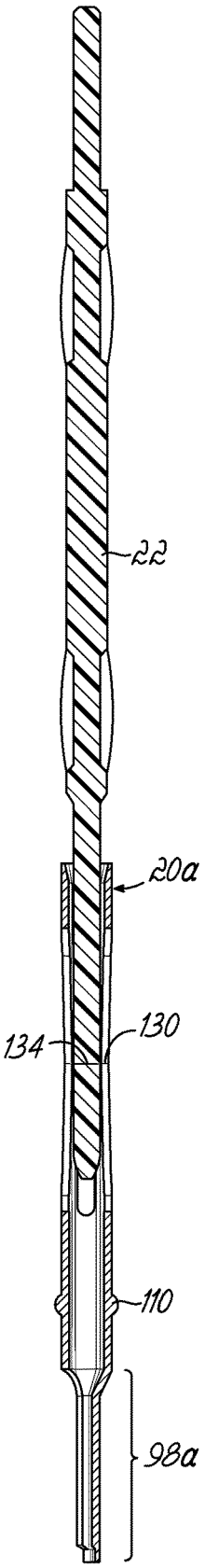

FIGS. 9A and 9B illustrate engagement of a pin of a male connector and a socket of a female connector in accordance with the invention. As illustrated, the spring fingers grip the pin along its length. For example, a suitable minimum contact might be approximately 1 mm of length between the pin and socket.

Referring again to FIG. 4, in accordance with another feature of the invention, the tip end 124 of the socket includes a chamfered surface or chamfer 150 that slopes into the pin receiving portion for guiding a pin 22 when the male and female connectors are mated and the pin is inserted in the socket. The chamfer might be angled at an angle of approximately 10-15 degrees with respect to the longitudinal axis of the socket.

Figure 4A:
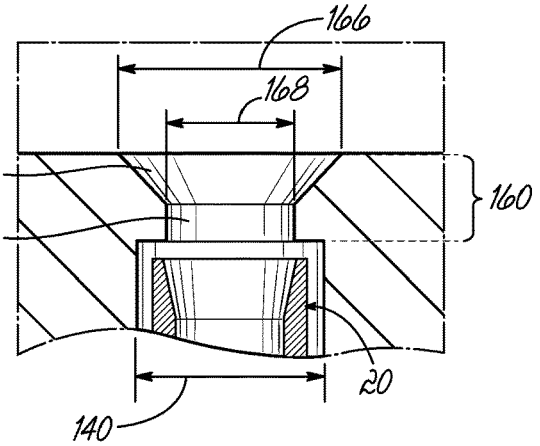
FIG. 4A is a partial cross-sectional view of the socket conductor of FIG. 4.

In accordance with another aspect of the invention as shown in FIG. 4A, aperture 40 is formed to include a chamfer region 160 that is positioned at the contact face surface 72 of the connector body. The chamfer region 160 tapers toward the tip end 124 of the pin receiving portion 100 of the socket 20 for directing a pin to the socket. More specifically, the chamfer region 160 includes an angled chamfer 162 which angles into a cylindrical section 164 that is generally of a smaller diameter than the diameter of the aperture in order to feed the pin into chamfer 150 of socket 20. Referring to FIG. 4A the connector body chamfer 162 angles in from a diameter 166 to the smaller diameter 168 of cylindrical region 164. That diameter 168 is smaller than the internal diameter 140 of the aperture and thus guides a pin 22 into chamfer 150 and the pin receiving portion 100 of the socket. In that way, stubbing of the pin is prevented and damage to the electrical connector assembly during mating and un-mating of the connectors is reduced.

Figure 4B:
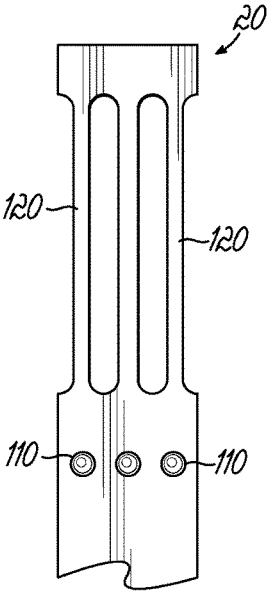
FIG. 4B is a plan view of a blank used to form a socket conductor as illustrated in FIG. 4.

Referring to FIG. 4B, socket 20 may be formed of a suitable flat blank wherein the spring fingers 120 may be appropriately stamped in the blank protrusions 110 are formed before it is rolled, such as around a die into the generally cylindrical socket having the features as noted herein. After it is formed, the various fingers may be bent radially inwardly as appropriate to achieve the inner diameter 132 to create a spring grip force on the pin and 22 around the circumference of the pin and socket.

FIG. 10 illustrates an embodiment of a male connector 14 and includes a connector body 28 to secure one or more pins 22. Connector body 28 includes one or more apertures 180 that extend between a mount face surface 76 and a contact face surface 78. The pins are modularly mounted within the connector body 28 similar to the sockets as discussed herein. Therefore, the invention provides further flexibility in pin arrangements to handle a number of different signal routing and encoding schemes. For example, the connector of the invention may provide single-ended signals, differential pair signals, as well as power, ground, and sideband signals. Furthermore, as discussed with respect to the sockets and FIGS. 7 and 8A-8D, a variety of different termination styles may be provided for the various pins. To that end, shown in FIG. 11, termination of the pins might also be provided through surface mount technology (SMT), paste-in-hole technology (PIH), plated through hole technology (PTH), or a press fit. FIG. 10 illustrates each such arrangement although it will be understood that generally a design will have all the same similarly terminated pins.

Figure 12:
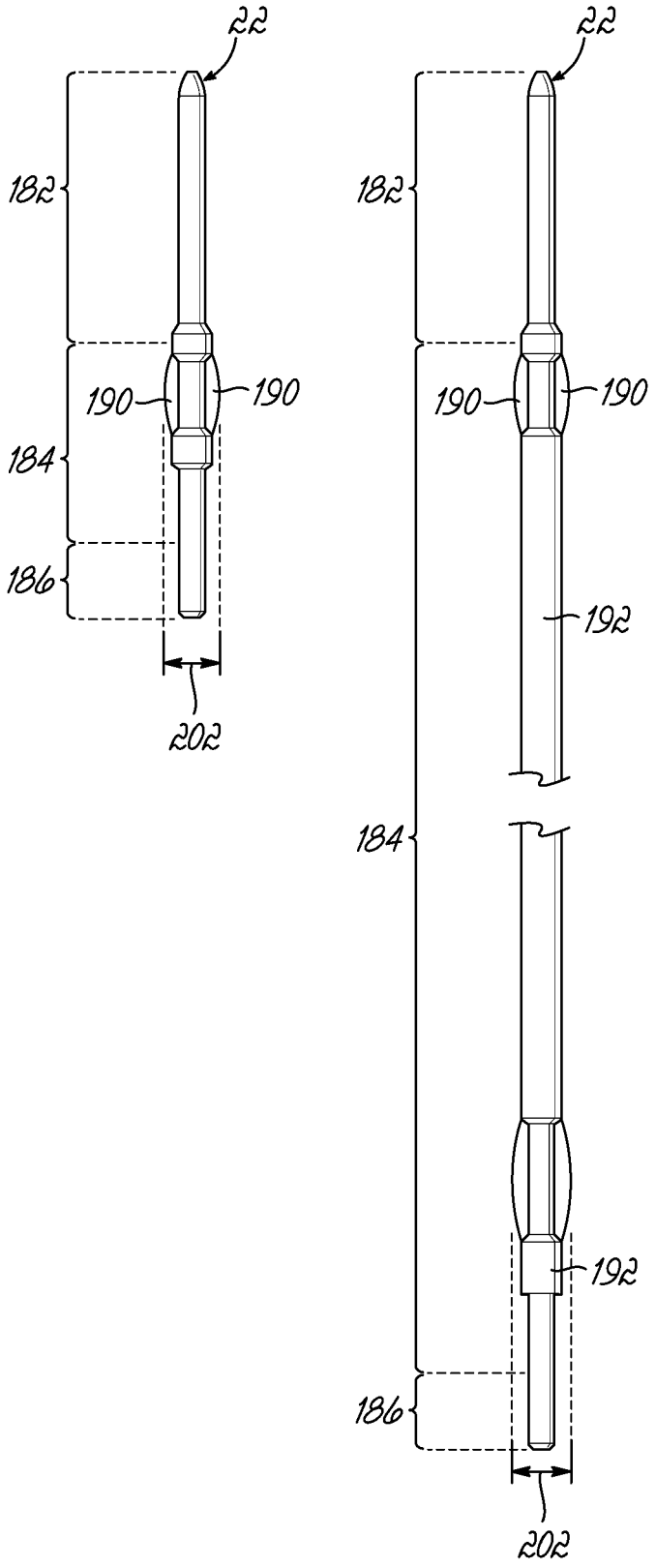
FIG. 12 is a side view of a pin conductor in accordance with one embodiment the invention.
Figure 13:
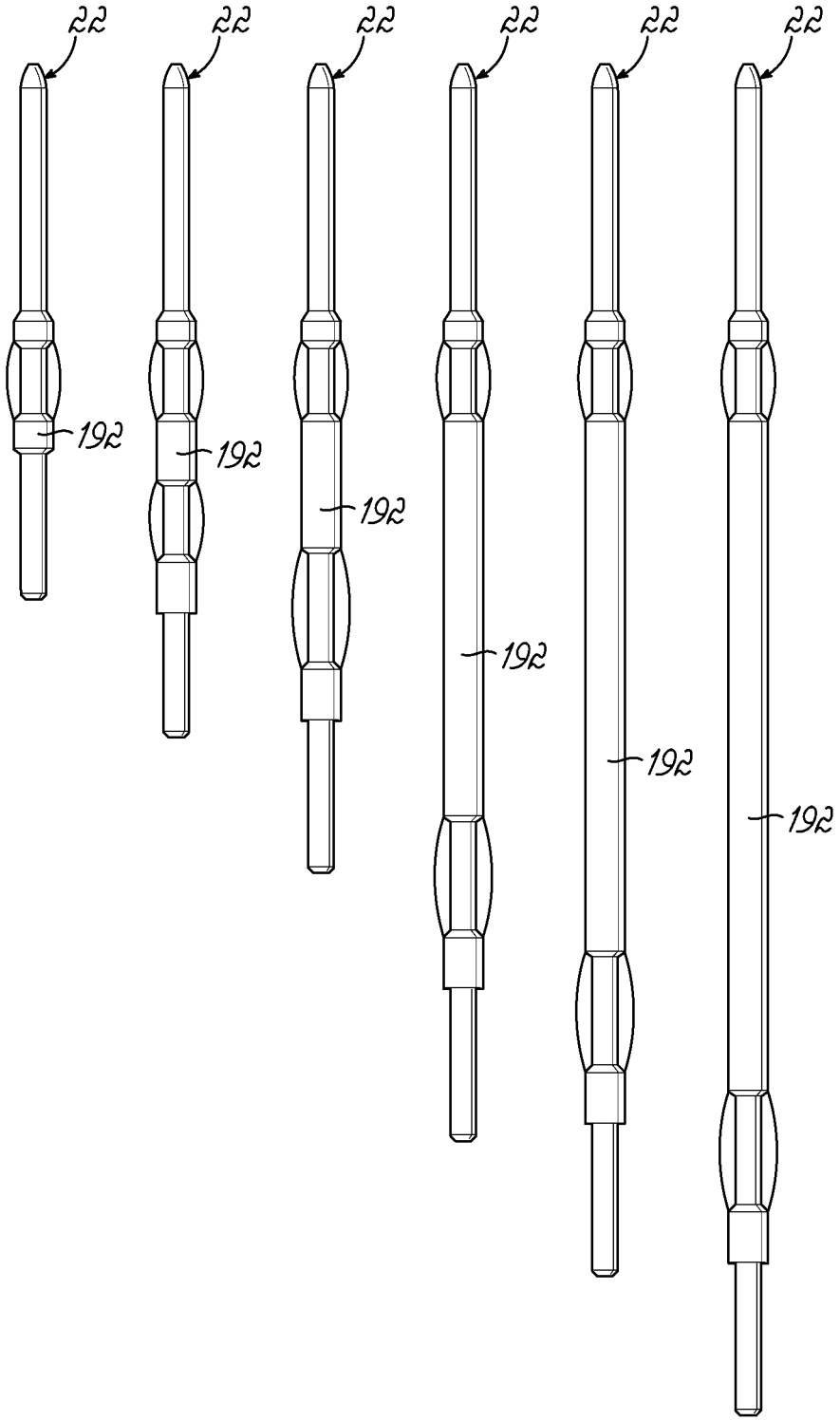
FIG. 13 is a side view of different lengths of pin conductors in accordance with embodiments of the invention.
Figure 14:
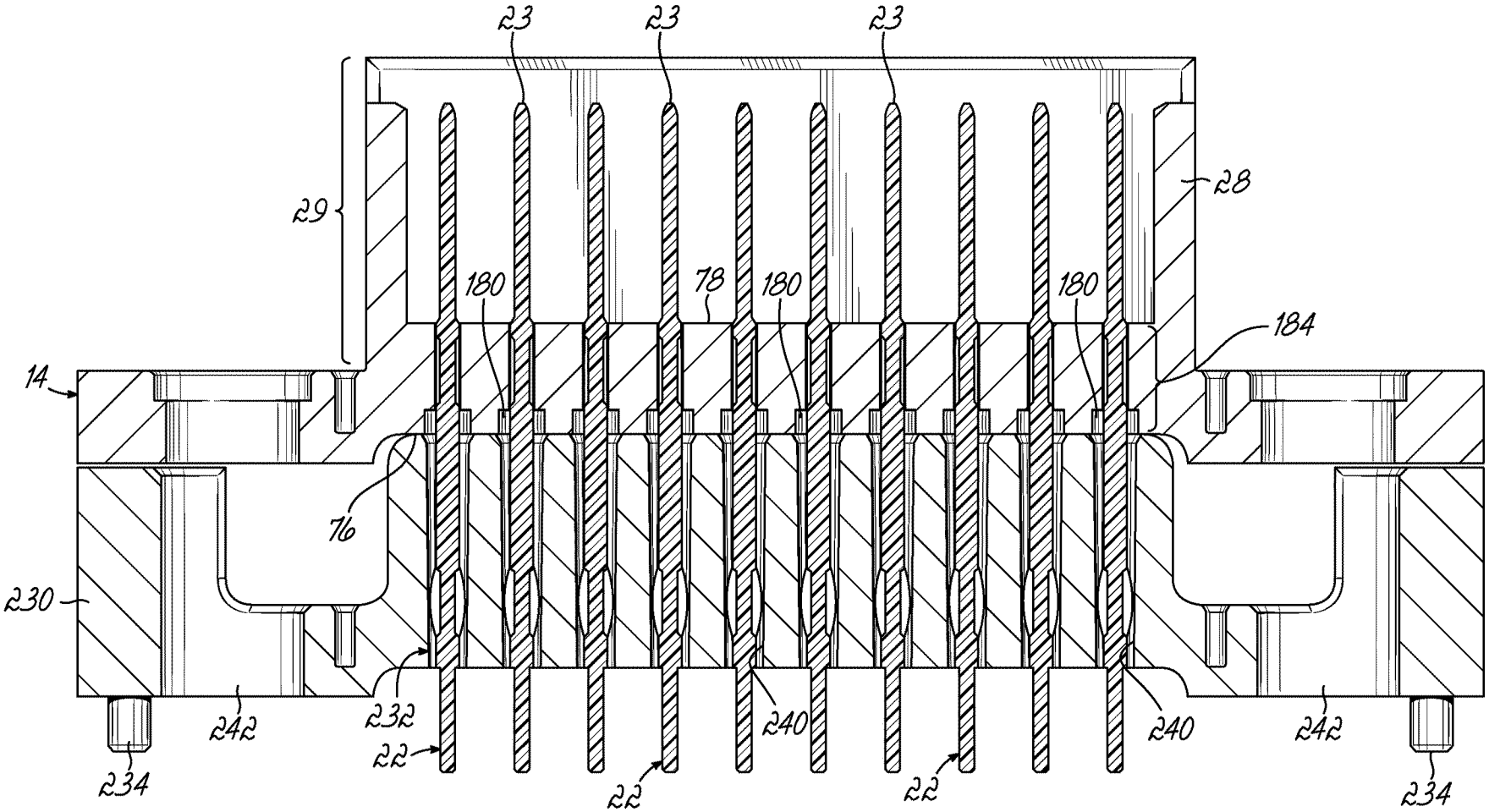
FIG. 14 is a cross-sectional view of a male connector in accordance with one embodiment of the invention.

To that end, as illustrated in FIG. 12 each of the pins will generally include a contact portion 182, a mount portion 184, and a termination portion 186. In accordance with one aspect of the present invention, the male connector provides scalability and spacing to the electrical connector assembly of the invention to adapt to a number of different board spacing scenarios. As discussed herein, various spacers may be added to the connector assembly with a requisite lengthening of the portions of the pin as illustrated in FIGS. 12 and 13 so that the pins extend from the contact face surface 78 through a defined mount face surface 76. As illustrated in FIG. 14, the mount face surface 76 is moved further and further from the contact face surface 78 depending upon the number of spacers that are utilized. The male connector body 28 may be formed of a suitable material similar to the female connector body as discussed herein. Similarly, the pins may be formed of a beryllium copper with appropriate nickel and gold plating. For example, the entire pin might be plated with 100 micro-inches of nickel. Then the pin context might be coded at the contact portions with 30-50 micro-inches of gold minimum and 5 micro-inches of gold on the termination portions 186 similar to the plating of the sockets 20. For securing the mount portions 184 of the pins within the respective apertures 180, as illustrated in FIG. 12, the pins include one or more protrusions that extend radially outwardly from a center or longitudinal axis of the pin. As illustrated in FIG. 12 a plurality of protrusions 190 are formed to extended radially outwardly from the body 192 of the pin. In one embodiment of the invention, the protrusions 190 are in the form of fins which extend along a section of the body 192 that forms the mount portion 184 of the pins 22. Generally, the body 192 of the pins may have a larger outer diameter than the contact portion 182 of each of the pins. The protrusions 190 extend radially outwardly from even the larger diameter body 192 to engage an inside surface of aperture 180 as illustrated in FIG. 10. In that way, the protrusions 190 form a friction fit or press fit in the apertures 180 similar to the friction fit of the sockets within the connector body of a female connector as described herein.

Figure 11:
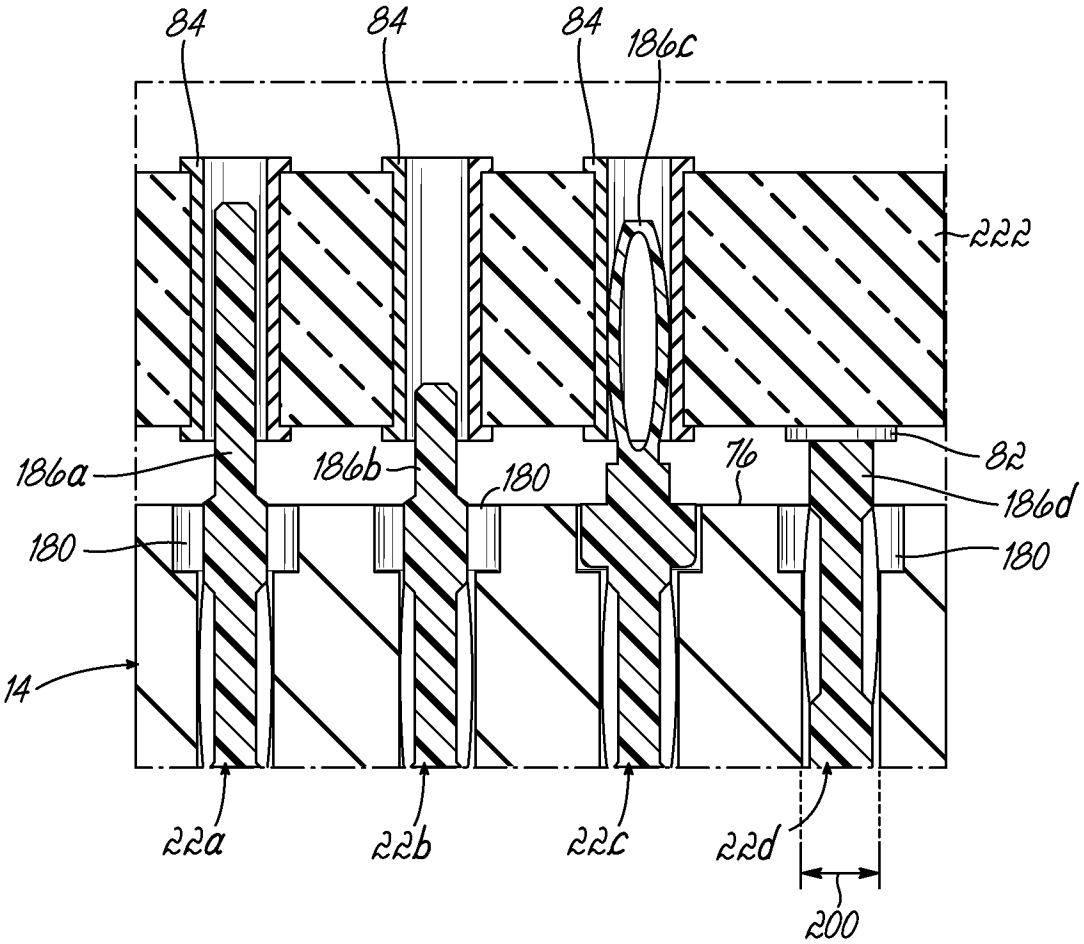
FIG. 11 is a partial cross-sectional view of pin conductors showing different termination portions in accordance with embodiments of the invention.

While FIG. 12 illustrates a series of pins that have termination portions 186 that would be suitable for plated-through-hole mounting, such as using a wave soldering technique, other termination portions may have different configurations. For example, as illustrated in FIG. 11 similar to FIG. 7, the termination portions 186*a*, 186*b*, 186*c* and 186*d* might be utilized for other termination mounting techniques, such as paste-in-hole, press fit, and surface mounting as appropriate. Referring to FIGS. 11 and 14, the apertures 180 in the connector body 28 might be configured to have an inner diameter 200 that is slightly smaller than the effective outer diameter 202 created by the protrusions 190 and the pins (See FIG. 12). In that way, a suitable friction fit may hold the various pins 22 in the connector body as appropriate for alignment with and insertion into the sockets when the male and female connectors are mated.

In accordance with another feature of the present invention, the electrical connector assembly is scalable in size to adjust to a number of different spacings between circuit boards. To that end, the electrical connector assembly incorporates modular spacers that may be implemented with at least one of the male and female connectors in order to provide an increased overall spacing between the mount face surfaces (and therefore circuit bands) of each of the connectors once they are mated together. For example, referring to FIGS. 6, 14 the connector body 28 for the male connector is illustrated without any sort of additional spacer elements. Rather, the pins 22 are mounted directly into apertures 180. FIG. 10 illustrates mated male and female connectors 12 wherein the pins are inserted into respective sockets. Such a mated assembly provides a specific spacing between circuit boards 220 and 222 based upon the dimensions of the male and female connectors and the effective space provided between the mount face surfaces 70 and 76 of the respective male connector and female connector. Referring to FIG. 10, the various pins and/or sockets associated with each connector will be appropriately coupled with the boards 220, 222, such as through plated through holes 84 and the respective boards using an appropriate termination method as discussed herein. Each of the connectors may further include additional mounting structures 224 that slide into apertures 226 in the boards, for anchoring the board to the body of the connector for soldering and connecting elements to the board. Furthermore, for alignment, the structures 44, 46 ensure that the pins are aligned with respective sockets as the male and female connectors are brought together for mating. Also, as noted, additional biasing structures such as threaded posts 60 and respective threaded nuts 61 might be utilized for securing each of the connectors and connector bodies to an appropriate printed circuit board.

Figure 15:
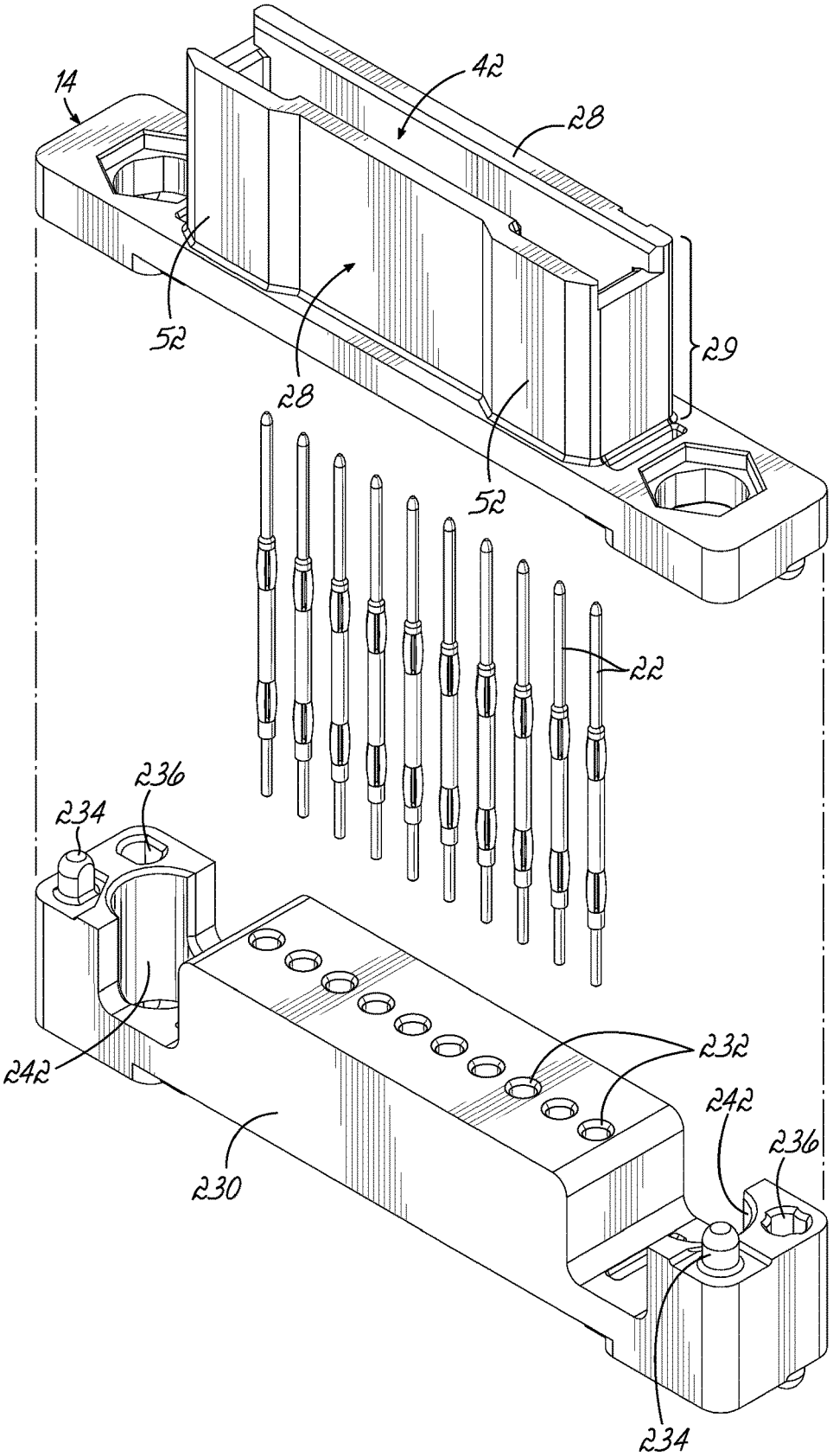
FIG. 15 is a perspective view of a male connector illustrating use of a spacer in accordance with one embodiment of the invention.
Figure 16:
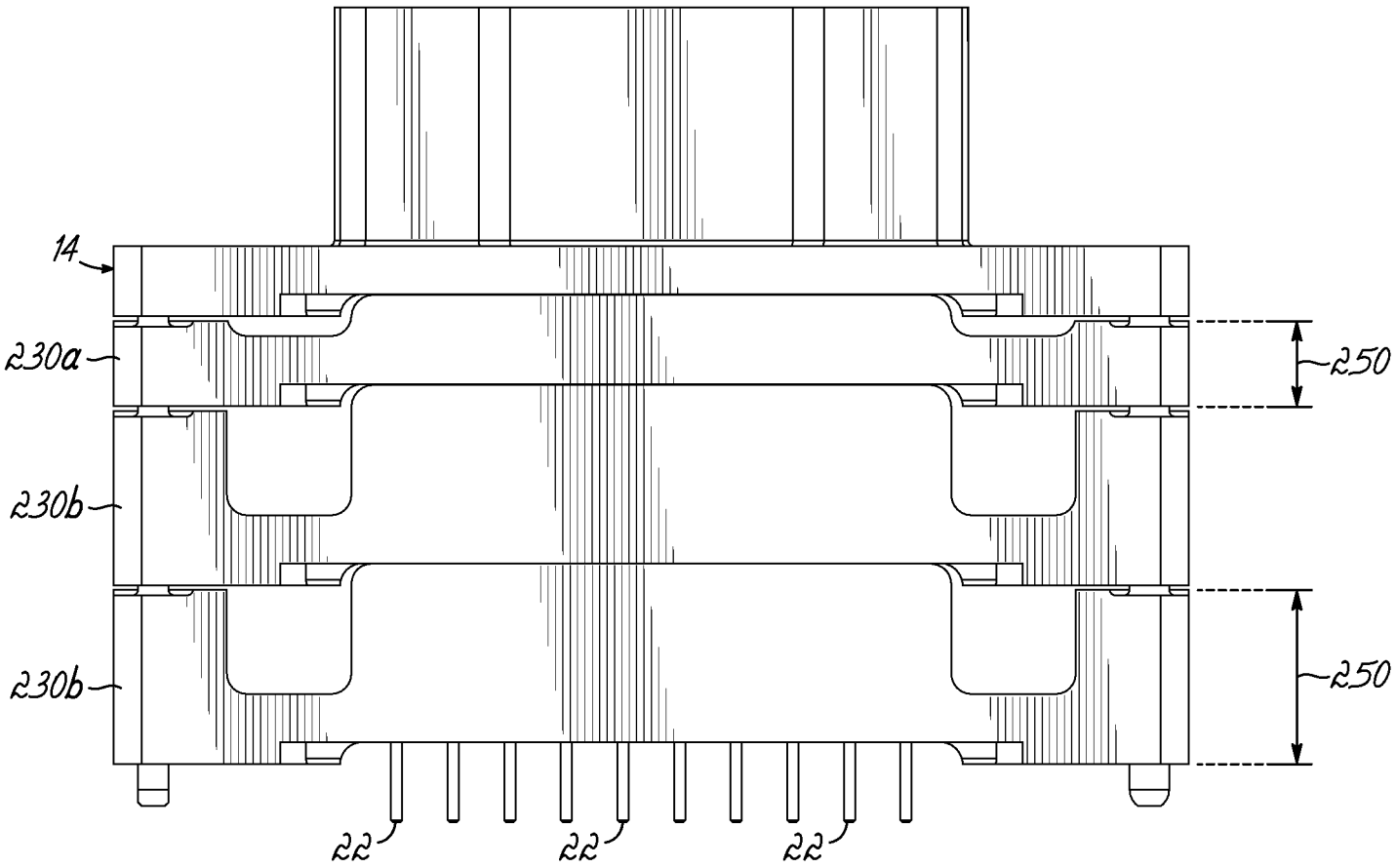
FIG. 16 is a side view of a connector assembly of the invention utilizing multiple spacers in accordance with one embodiment of the invention.

In scenarios wherein greater spacing is needed between the boards, one or more modular spacers might be utilized with the connector body of a particular connector. Referring to FIGS. 14-16, a spacer element 230 may be utilized to form part of the connector body for the male or female connectors. In the illustrations, the one or more spacer elements 230 are shown utilized with a male connector. However, a similar concept might be utilized with a female connector.

More specifically, the spacer element 230 is stacked with connector body 28 as illustrated in FIG. 15. The spacer element 230 includes one or more apertures 232 which will align with apertures 84 in the connector body 28 when the connector body and spacer element 230 are mated together. For proper mating, each of the connector body and spacer element might include various alignment structures such as posts 234 and respective holes 236 that are shaped and configured to come together with counterpart elements between each of the connector body and spacer element. In accordance with one feature of the invention, in order to accommodate the use of the spacer element 230, the various electrical connector elements, such as a socket or pin, are appropriately elongated to span between a mount face surface, such as surface 76, and a contact face surface such, as face surface 78, as illustrated in FIG. 14. For example, FIG. 13 shows several series of elongated pins 22 for different applications. Wherein generally, the mount face surface 76 might be on one side of the connector body 28 opposite contact face surface 78, when a spacer or element as illustrated FIG. 14, that mount face surface 76 is moved or spaced further from the contact face surface 78 to accommodate greater spacing between printed circuit boards. As illustrated in FIGS. 12 and 13, the mount portion 184 of each of the connector elements, such as pins 22 maybe lengthened as appropriate to span the additional distance created by the spacer element 230. To that end, in addition to a longer mount portion 184, the various contacts might include additional protrusions 190. Referring to FIG. 12, pins of certain length may include two or more sets of protrusions. In the illustrated example of FIG. 15, two sets of protrusions 190 are utilized, generally one at each end of the mount portion 184 of the pin (See FIG. 12). As illustrated in FIG. 14, those additional protrusions will press against an interior surface 240 of the various apertures 232 for a press fit or friction fit securement of the pin 22 in addition to the securement within the apertures 84 in the connector body 28. As such, the connector body 28 and spacer element 230 essentially create a longer connector or effective connector body as needed.

Generally, the pins 22 will extend into open space in the connector as illustrated in FIG. 14. Accordingly, the connector body 28 for the male connector might include the protective shroud 29 that extends generally from the contact face surface 78 and past the forward-most tips 23 of the pins 22. In that way, the pins are protected from damage. Generally, the shroud 29 will be configured for receiving the connector body 26 of the female connector when the two connectors are mated. For receiving structures 60 for mounting the various connectors to a circuit board, the spacer element 230 will also incorporate appropriate openings 242 so that spacer element 230 will act as an extension to connector body 28.

In accordance with another aspect of the invention, as illustrated in FIG. 16, multiple spacer elements 230 may be stacked with each other to further increase the effective length of the connector body 28 as needed for particular applications. As such, multiple spacer elements 230 may be utilized. Those spacer elements can be of a similar length or might have varying lengths. In accordance with one embodiment, the spacer elements might have an effective length or height 250 of 4 mm to provide an increase in stack height by 4 mm. Although the present invention is not limited to such a dimension and a lesser or greater dimension may be utilized. Furthermore, different spacer elements of differing lengths 250 might be utilized together depending upon the spacing differential between circuit boards that must be addressed. For example, as illustrated in FIG. 16, spacer elements 230*a* has a smaller overall length or height 250 than other spacer elements 230*b* as utilized. In that way, the overall height/length of the effective connector body can be varied as necessary.

Figure 17:
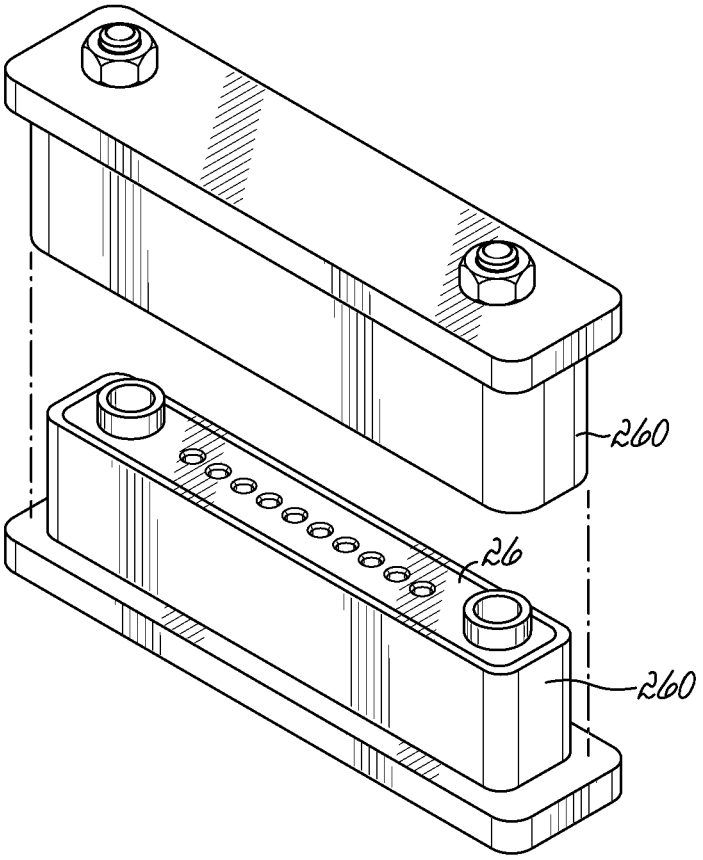
FIG. 17 is a perspective view of a connector assembly incorporating protective shells on the connector bodies.

In accordance with another aspect of invention, each of the various connector bodies may be surrounded by a shell so as to provide a more rugged connector and also to provide electromagnetic shielding. For example, as shown in FIG. 17 a shell 260 made of an appropriate metal such as aluminum might be implemented around one or both of the connector bodies from prove ruggedness and shielding of the connectors when mated.

Figure 18:
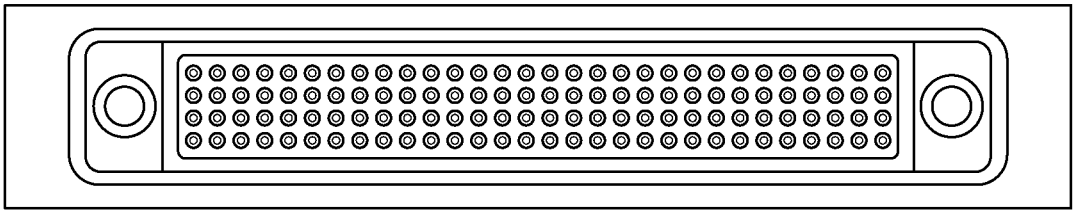
FIG. 18 is a top view of a connector assembly in accordance with one embodiment of the invention showing multiple rows of conductors.

In the illustrated embodiments, for simplicity, male and female connectors are shown with conductors in a single row. However, it will be understood by a person of ordinary skill in the art, the present invention may utilize multiple rows such as 2-4 or a greater number of rows as desired for a particular application. For example, FIG. 18 shows 4 rows. Furthermore, the length of the rows and the number of electrical components in each of the rows is not limited with respect to the invention. Accordingly, the electrical connector assembly of the invention may be scaled up and down with respect to the number of signal conductors (pin/sockets) as implemented in a variable number of rows and columns, as well as the spacing provided by the mated electrical connector assembly as described herein.

The present invention provides flexibility in the signal routing and coding schemes utilized in the connector assembly which may include single-ended, differential pair, power, ground and sideband signals. Accordingly, the electrical connector assembly of the present invention is scalable in the X, Y and Z axes. The design provides a highly reliable three points of contact between each of the pins and sockets and the configuration provides significant stubbing reduction when the connectors are mated. The connector can handle high speeds up to and exceeding 56 Gbps applications and further, even with the small size, and is able to handle up to 2 Amps of current. Furthermore, the small connector size, which is provided by the unique arrangement and construction of the pin and socket elements, minimizes the impact on the printed circuit board real estate. For example, in one embodiment of the invention, an electrical connector assembly may be provided with up to 200 positions that can be arranged in 1-4 rows with each row having 10, 20, 30, 40 or 50 positions. Furthermore, the board spacing provided by the electrical connector assembly of the invention might be varied by 8, 10, 12, 16, 18 and 20 mm as desired. Still further, the inventive electrical connector assembly may comprise and utilize a number of different termination styles including paste-in-hole, surface mount technology, plated-through-hole (wave solder) and compliant or press fit termination. As such, the present invention provides significant benefits over existing connector arrangements for high-speed electrical connectors.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details representative apparatus and method, and illustrative examples shown and described. Accordingly, departures may be made from such details without departure from the spirit or scope of applicant's general inventive concept.

What is claimed is:

1. A high speed electrical connector assembly comprising:

a female connector including at least one socket;

a male connector including at least one pin;

the male and female connectors configured for mating together for inserting the at least one pin into the at least one socket;

the female connector comprising:

a connector body formed to define a mount face surface and contact face surface;

the connector body including at least one aperture extending therein between the mount face surface and the contact face surface;

the at least one socket positioned in the connector body aperture, the at least one socket forming a cylindrical socket including a mount portion having a cylindrical outer surface and a pin receiving portion;

the mount portion of the socket including protrusions extending radially outwardly from around the circumference of the outer surface and configured for engaging an internal surface of the aperture proximate the mount face surface for securing and centering the socket in the aperture in a fixed orientation spaced from the internal surface of the aperture;

the pin receiving portion including a chamfer at the tip end that slopes inwardly into the pin receiving portion for guiding the at least one pin into a plurality of spring fingers, the spring fingers extending along the length of the pin receiving portion and being positioned in generally equal angular increments around the cylindrical socket, the spring fingers flexing radially inwardly in the socket away from the internal surface for engaging the at least one pin received in the socket;

the pin receiving portion and spring fingers being maintained in a free-floating position away from the internal surface of the aperture with a tip end of the pin receiving portion being positioned below the contact face surface for forming an air gap that surrounds the pin receiving portion and the tip end in the aperture.

2. The high speed electrical connector assembly of claim 1 wherein the female connector includes a plurality of sockets and the male connector includes a plurality of pins.

3. The high speed electrical connector assembly of claim 1 further comprising three spring fingers positioned in generally 120 degree angular increments around the cylindrical socket and flexing radially inwardly in the socket.

4. The high speed electrical connector assembly of claim 1 wherein the socket further includes a termination portion coupled with the mount portion of the socket opposite the pin receiving portion, the termination portion configured for terminating with a conductor for providing an electrical signal to the socket.

5. The high speed electrical connector assembly of claim 1 wherein the socket is formed of beryllium copper.

6. The high speed electrical connector assembly of claim 1 wherein the socket is plated with gold.

7. The high speed electrical connector assembly of claim 1 wherein the at least one aperture includes a chamfer region positioned at the contact face surface of the connector body, the chamfer region tapering toward the chamfer at the tip end of the pin receiving portion of the socket for directing a pin to the socket.

8. The high speed electrical connector assembly of claim 7 wherein the tip end of the pin receiving portion sits below the chamfer region for forming the air gap around the tip end.

9. A high speed electrical connector comprising:

a connector body formed to define a mount face surface and contact face surface;

at least one aperture extending in the connector between the mount face surface and the contact face surface;

at least one socket positioned in the aperture, the at least one socket forming a cylindrical socket including a mount portion having a cylindrical outer surface and a pin receiving portion;

the mount portion of the socket including protrusions extending radially outwardly from around the circumference of the outer surface and configured for engaging an internal surface of the aperture proximate the mount face surface for securing and centering the socket in the aperture in a fixed orientation spaced from the internal surface of the aperture;

the pin receiving portion including a chamfer at the tip end that slopes inwardly into the pin receiving portion and a plurality of spring fingers positioned in generally equal angular increments around the cylindrical socket, the spring fingers flexing radially inwardly in the socket away from the internal surface for engaging a pin received in the socket;

the pin receiving portion being maintained in a free-floating position away from the internal surface of the aperture with a tip end of the pin receiving portion being positioned below the contact face surface for forming an air gap that surrounds the pin receiving portion and the tip end in the aperture.

10. The high speed electrical connector of claim 9 further comprising a plurality of sockets.

11. The high speed electrical connector of claim 9 further comprising three spring fingers positioned in generally 120 degree angular increments around the cylindrical socket and flexing radially inwardly in the socket.

12. The high speed electrical connector assembly of claim 9 wherein the socket further includes a termination portion coupled with the mount portion of the socket opposite the pin receiving portion, the termination portion configured for terminating with a conductor for providing an electrical signal to the socket.

13. The high speed electrical connector assembly of claim 9 wherein the socket is formed of beryllium copper.

14. The high speed electrical connector assembly of claim 9 wherein the socket is plated with gold.

15. The high speed electrical connector of claim 9 wherein the at least one aperture includes a chamfer region positioned at the contact face surface of the connector body, the chamfer region tapering toward the chamfer at the tip end of the pin receiving portion of the socket for directing a pin to the socket.

16. The high speed electrical connector assembly of claim 15 wherein the tip end of the pin receiving portion sits below the chamfer region for forming the air gap around the tip end.

* * * * *